US012409872B1

(12) United States Patent
Zaerr et al.

(10) Patent No.: US 12,409,872 B1
(45) Date of Patent: Sep. 9, 2025

(54) COUPLER CROSS KEYS

(71) Applicant: GUNDERSON LLC, Portland, OR (US)

(72) Inventors: Jon B. Zaerr, Portland, OR (US); Gregory J. Saxton, Portland, OR (US)

(73) Assignee: Gunderson LLC, Lake Oswego, OR (US)

( * ) Notice: Subject to any disclaimer, the term of this patent is extended or adjusted under 35 U.S.C. 154(b) by 822 days.

(21) Appl. No.: 17/709,233

(22) Filed: Mar. 30, 2022

Related U.S. Application Data

(60) Provisional application No. 63/170,824, filed on Apr. 5, 2021.

(51) Int. Cl.
*B61G 9/24* (2006.01)

(52) U.S. Cl.
CPC ..... *B61G 9/24* (2013.01)

(58) Field of Classification Search
CPC ... B61G 1/32; B61G 9/00; B61G 9/02; B61G 9/054; B61G 9/12; B61G 9/22
See application file for complete search history.

(56) References Cited

U.S. PATENT DOCUMENTS 1,962,313 A * 6/1934 Lehman ..... B61G 9/22 213/70

* cited by examiner

*Primary Examiner* — Robert J McCarry, Jr.
(74) *Attorney, Agent, or Firm* — Chernoff, Vilhauer LLP

(57) ABSTRACT

EOCC draft gear assemblies and cross keys for those assemblies are disclosed. In one embodiment, the cross key consists of a unitary generally T-shaped member having opposed lateral first and second end portions, a base portion formed with the first end portion, and a transition portion disposed between the base portion and the second end portion and formed with the base portion and the second end portion. The transition portion includes opposed longitudinal first and second transition faces. Each of the first and second transition faces has a shape that includes two or more radiuses of curvature.

13 Claims, 8 Drawing Sheets

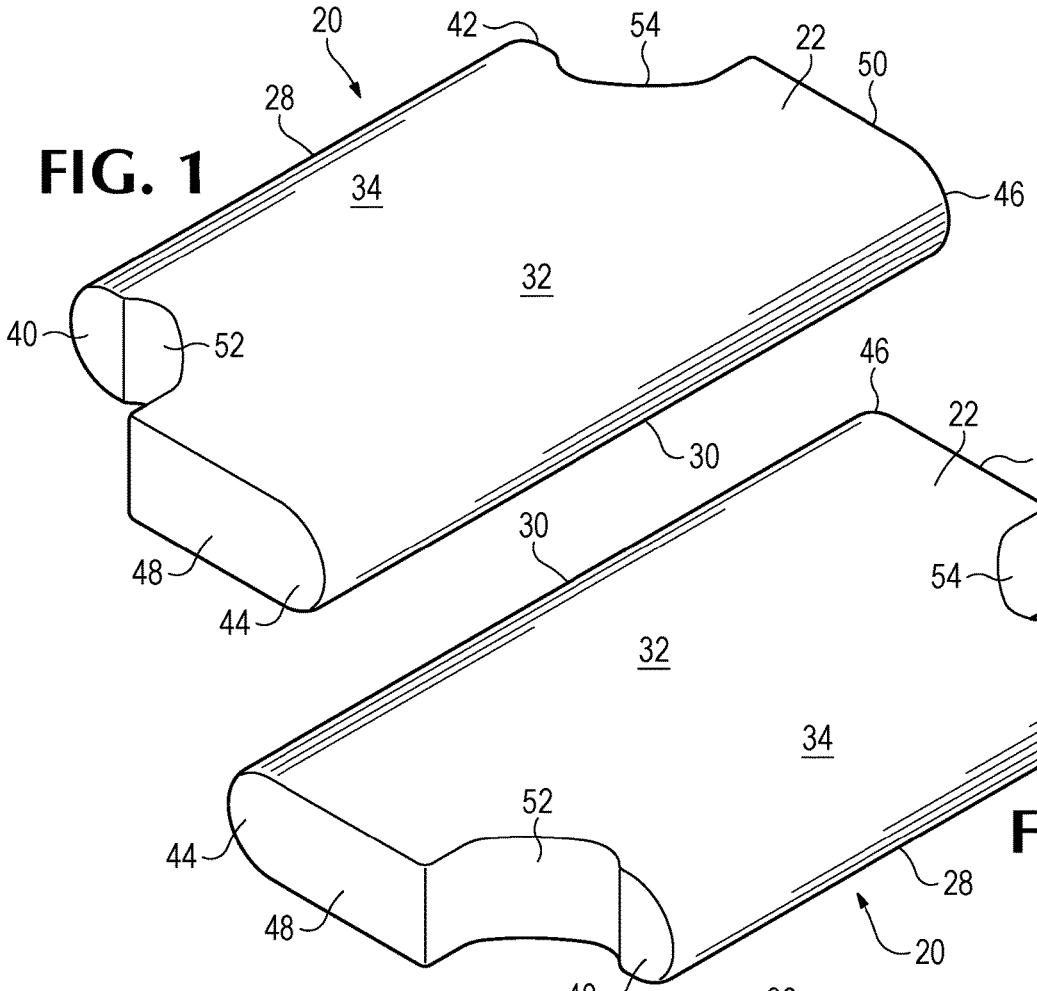
FIG. 1
FIG. 2
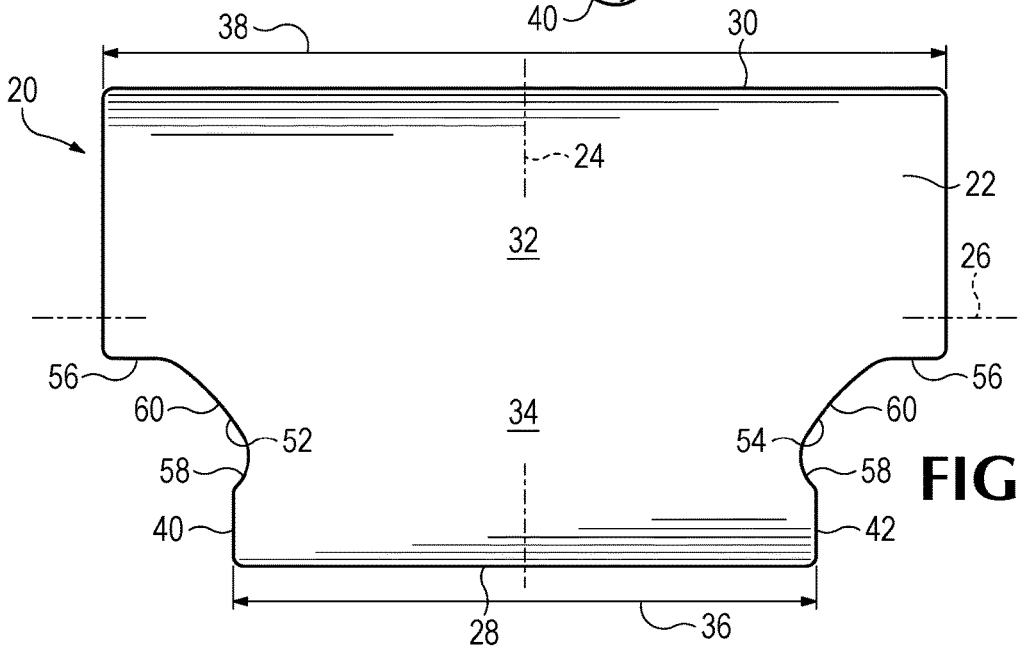
FIG. 3

COUPLER CROSS KEYS

CROSS-REFERENCE TO RELATED APPLICATIONS

This application claims the benefit of U.S. Provisional Patent Application Ser. No. 63/170,824 filed on Apr. 5, 2021 and entitled "Coupler Cross Keys." The complete disclosure of the above application is hereby incorporated by reference for all purposes.

BACKGROUND OF THE DISCLOSURE

The present invention relates to end-of-car-cushioning (EOCC) draft gear assemblies, and in particular to improved coupler cross keys for EOCC draft gear assemblies.

Cross keys are inserted through a slot in a coupler and yoke to tie the draft system to the coupler. Current cross keys are being stressed from, for example, longitudinal contact with the cross key retaining mechanism during use, which may result in fatigue cracks and subsequent failure. Catastrophic cross key failure can lead to train derailments and delay. What is desired, then, is an EOCC draft gear assembly having an improved cross key that is resistant to fatigue cracks and failure.

SUMMARY OF THE DISCLOSURE

As an answer to at least some of the needs explained above, EOCC draft gear assemblies and improved cross keys are disclosed hereinbelow and defined in the claims that form a part of the disclosure.

In one embodiment of the coupler cross key disclosed herein, the coupler cross key includes transition portions with particular arcuate faces between the base and the wings of the coupler cross key that are shaped to avoid longitudinal contact with the cross key retaining mechanism.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

FIGS. 1-2 are isometric views of an example of a coupler cross key.

FIG. 3 is a top view of the coupler cross key of FIGS. 1-2.

DETAILED DESCRIPTION OF PREFERRED EMBODIMENTS

Figure 4:
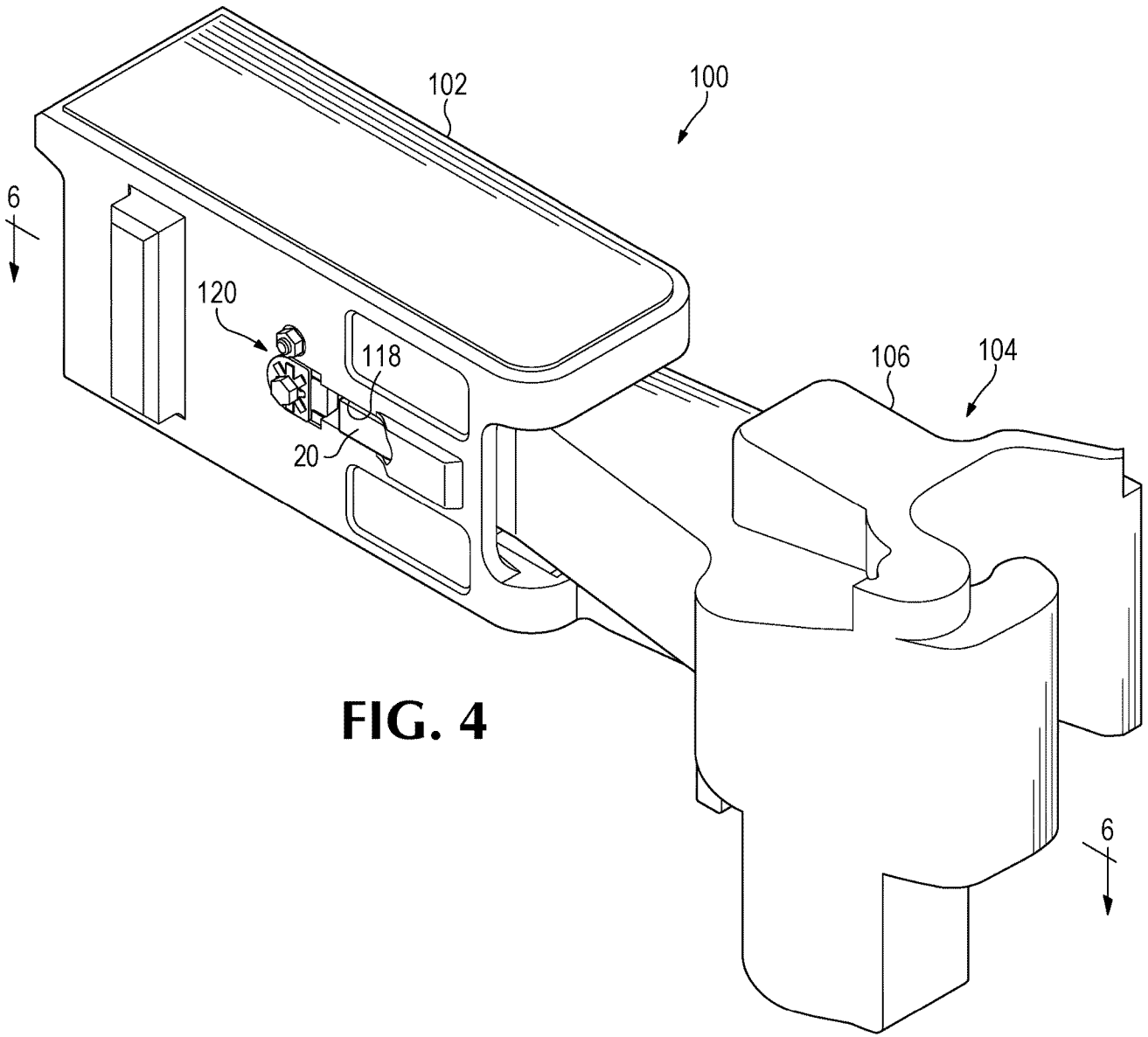
FIG. 4 is an isometric view of an example of an EOCC draft gear assembly having the coupler cross key of FIGS. 1-2.
Figure 5:
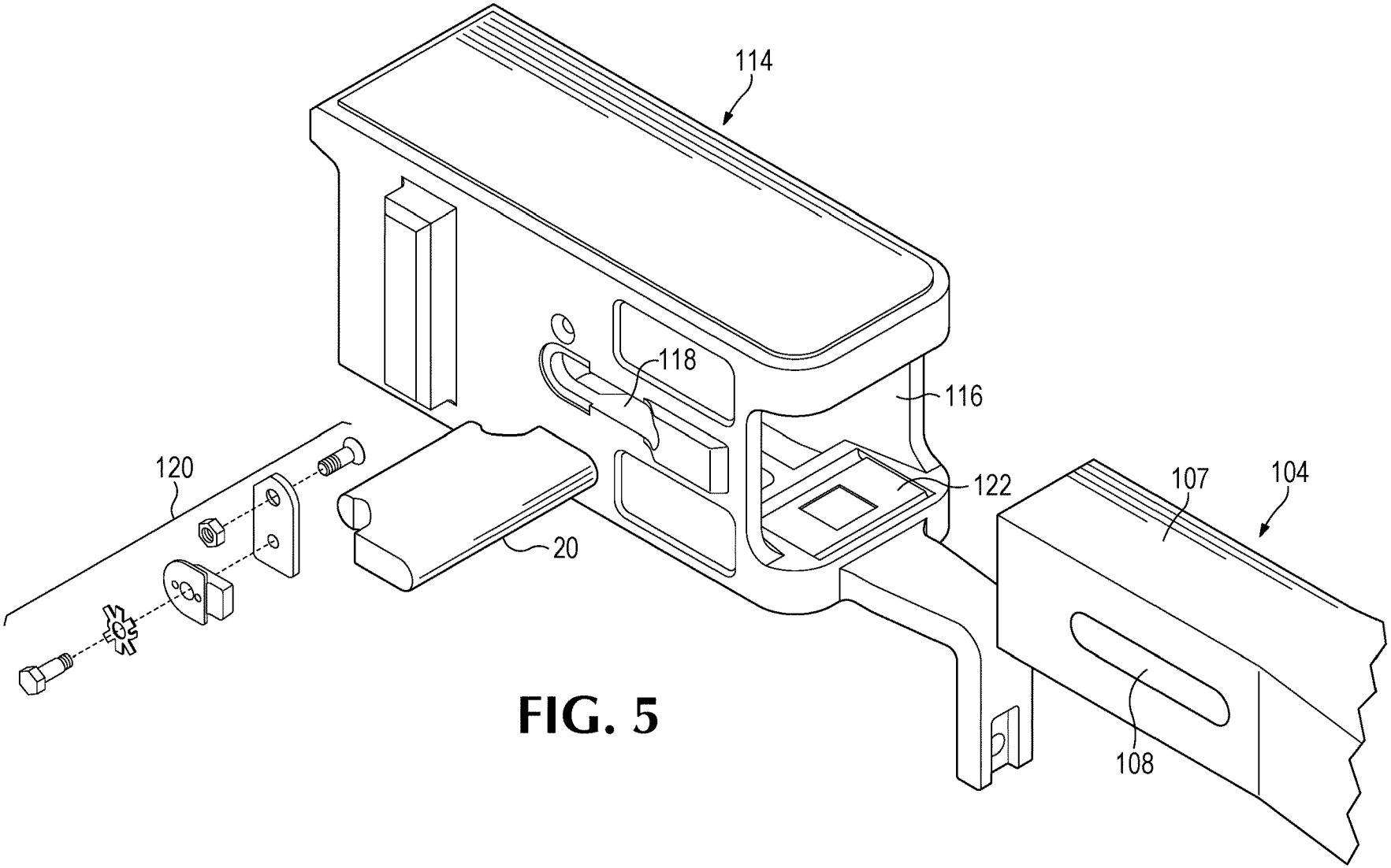
FIG. 5 is an exploded view of the EOCC draft gear assembly of FIG. 4.
Figure 6:
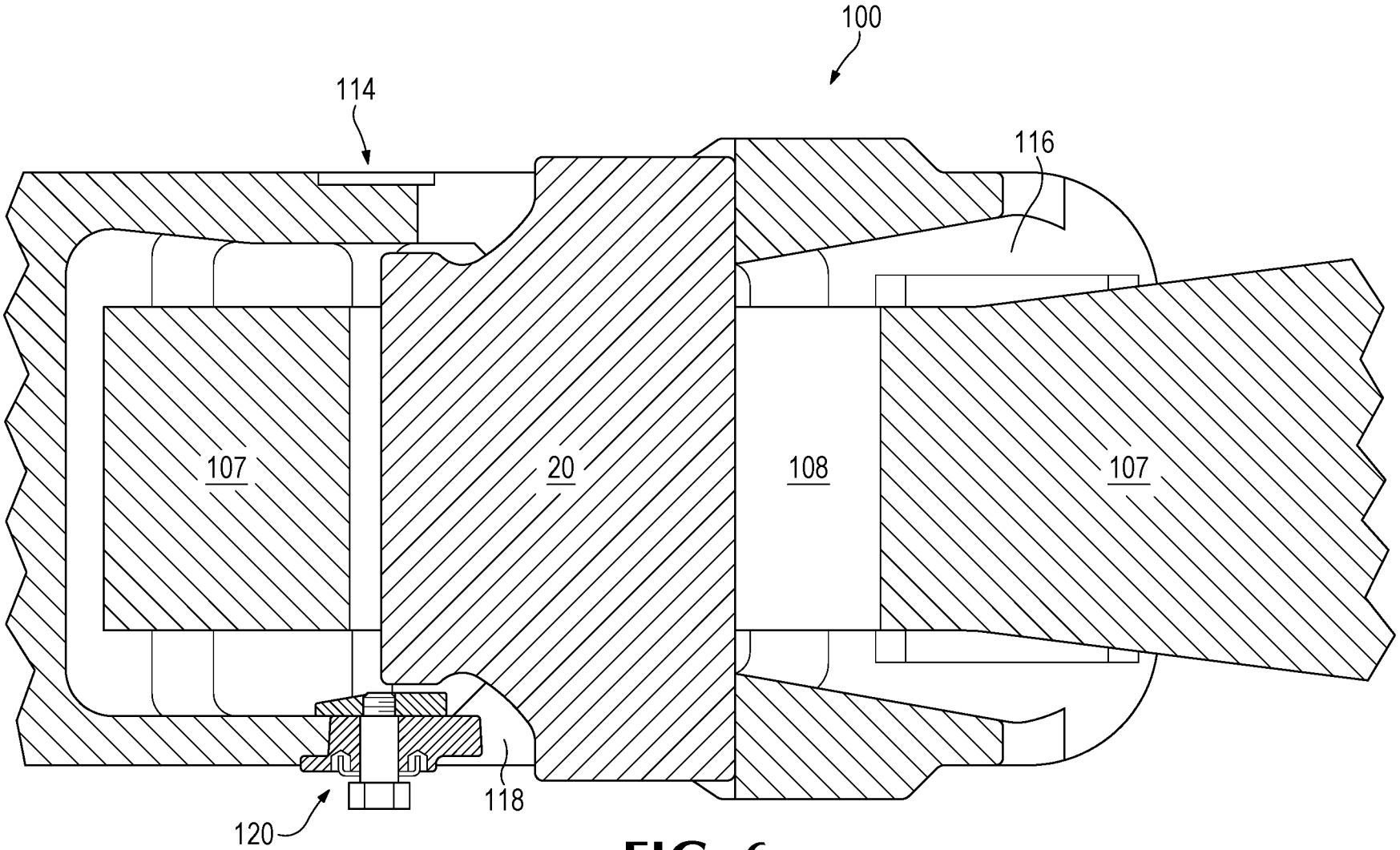
FIGS. 6-8 are partial sectional views of the EOCC draft gear assembly of FIG. 4 taken along lines 6-6 in FIG. 4 showing the EOCC draft gear assembly in use.
Figure 7:
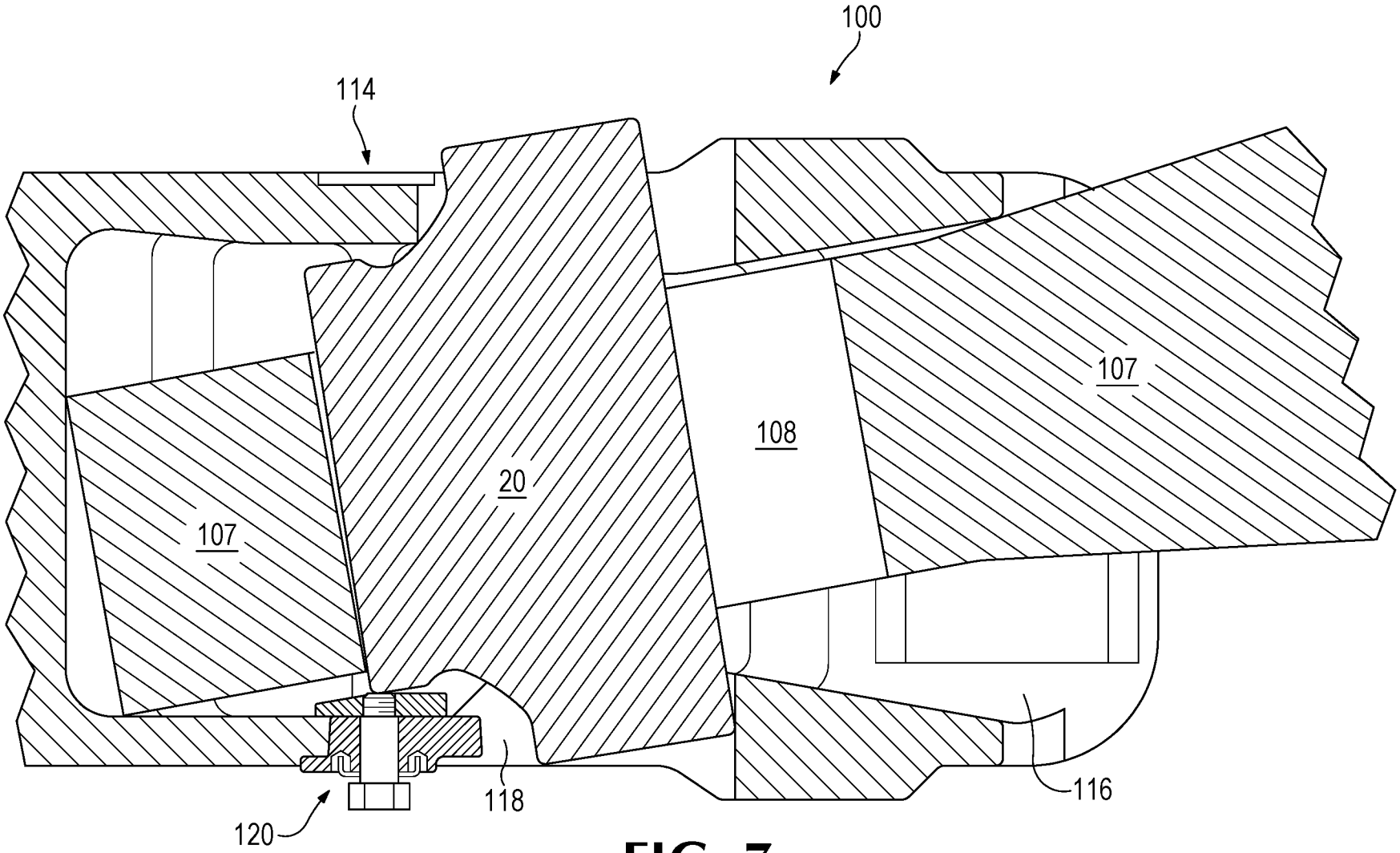
Figure 8:
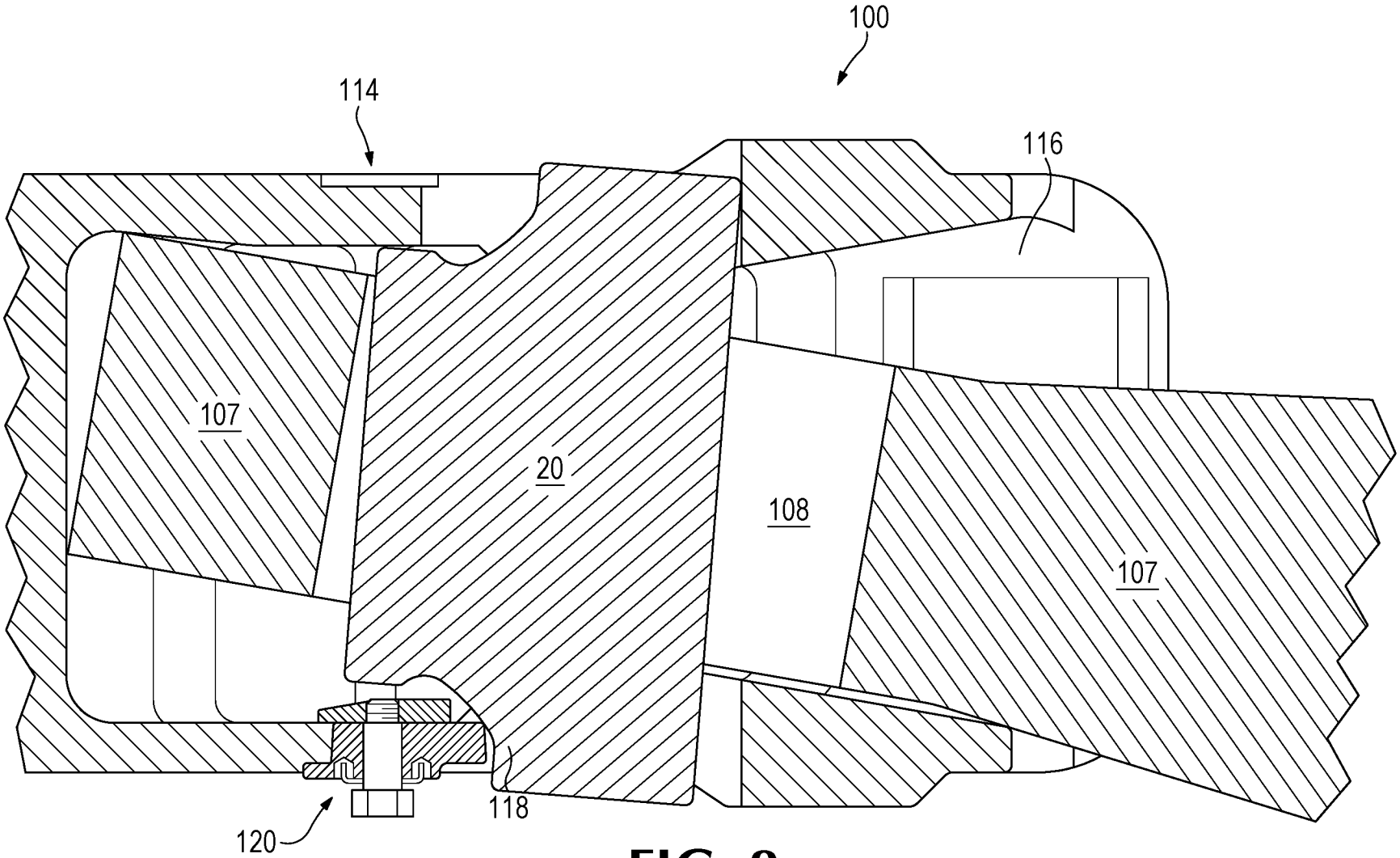

Referring to FIGS. 1-3, a cross key 20 for an EOCC draft gear assembly is shown. Unless explicitly excluded, cross key 20 may include one or more portions and/or one or more structures of other cross keys of the present disclosure. Cross key 20 is a T-shaped (or generally T-shaped) unitary metal plate 22 defining a lateral axis 24 and a longitudinal axis 26. The cross key includes opposed first and second end portions 28 and 30, a base portion 32, and a transition portion 34. Base portion 32 is formed with second end portion 30, and transition portion 34 is disposed between base portion 32 and first end portion 28 and is formed with the base portion and the second end portion. In other words, the base and transition portions are disposed between the first and second end portions.

First and second end portions 28 and 30 are opposed along lateral axis 24 of cross key 20. The first and second end portions each have (or generally have) a semi-cylindrical shape or half-cylindrical shape with its planar face formed with either base portion 32 or transition portion 34. In other words, the arcuate face of the first and second end portions face away and/or are spaced from base portion 32 and transition portion 34. Second end portion 30 includes a length 38 measured parallel to the longitudinal axis (e.g., about 10⅛ inches) that is greater than a length 36 of first end portion 28 (e.g., about 7 inches). The first end portion is centered (or generally centered) about lateral axis 24. In other words, half (or about half) of the length of first end portion 28 is on one side of lateral axis 24 and the other half (or remainder) of the length is on the other side of the lateral axis. Additionally, first end portion 28 includes opposed longitudinal end faces 40 and 42. Similarly, second end portion 30 includes opposed longitudinal end faces 44 and 46. In other words, end faces 40 and 42 are opposed along longitudinal axis 26, and end faces 44 and 46 are opposed along the longitudinal axis.

Base portion 32 has (or generally has) a rectangular prism shape. The base portion includes opposed longitudinal end faces 48 and 50. In other words, end faces 48 and 50 are opposed along longitudinal axis 26. In the example shown in FIGS. 1-3, end face 48 of base portion 32 is co-planar and/or formed with end face 44 of second end portion 30. Similarly, end face 50 of the base portion is co-planar and/or formed with end face 46 of the second end portion.

Transition portion 34 has (or generally has) a trapezoidal prism shape. The transition portion includes opposed longitudinal transition faces 52 and 54. In other words, transition faces 52 and 54 are opposed along lateral axis 24. Transition face 52 connects end face 40 of first end portion 28 with end face 48 of base portion 32 and end face 44 of second end portion 30. Similarly, transition face 54 connects end face 42 of the first end portion with end face 50 of the base portion and end face 46 of the second end portion. The connected transition and end faces described above form a portion of the outside perimeter of cross key 20.

Transitional faces 52 and 54 each has a shape that includes two or more radiuses of curvature. In some embodiments, each of the transition faces includes only two radiuses of curvature. In the example shown in FIGS. 1-3, transition faces 52 and 54 each includes opposed end portions 56 and 58 and an intermediate portion 60 disposed between those end portions. Each of the above end portions and intermediate portion may include a radius of curvature that is the same and/or different from the other portions. For example, end portion 56 and/or 58 may have a radius of curvature that is different from intermediate portion 60. Additionally, end portions 56 and 58 may have the same or different radius of curvature. In the example shown in FIGS. 1-3, end portions 56 and 58 has a radius of curvature of about 0.5 inches, while intermediate portion 60 has a radius of curvature of about three inches. However, other examples of cross key 20 may include transitional faces 52 and 54 with other suitable radiuses of curvature.

Referring to FIGS. 4-8, an example of an end-of-car-cushioning (EOCC) draft gear assembly 100 is shown having cross key 20. EOCC draft gear assembly 100 includes a carrier plate 102 and a coupler 104 that is used for connection of cars and locomotives. In the example shown in FIGS. 4-8, coupler 104 is an E-type coupler having an E-type head 106 and a tail 107 with a horizontal or key slot 108 (shown in FIG. 5) through which a draft or cross key passes.

EOCC draft gear assembly 100 also includes a cushioning unit and a follower (not shown). The cushioning unit absorbs the energy of the equipment coupling together and also provides a rebound force that maintains slack between the cars to allow cars to be moved without damage to other components or to the products within the cars. The follower mechanically connects the cushioning unit to the other components of EOCC draft gear assembly 100. The EOCC draft gear assembly further includes a yoke 114, which connects coupler 104 and the cushioning unit and the follower. The yoke includes a front opening 116 to receive tail 107 of coupler 104. Yoke 114 also includes horizontal slots 118 to receive a cross key. The yoke further includes a cross key retaining mechanism 120. Yoke 114 also includes a wear plate 122, which is a contact point for tail 107 of coupler 104 when the EOCC draft gear assembly is in use.

EOCC draft gear assembly 100 additionally includes cross key 20. Cross key 20 is received in horizontal slots 118 of yoke 114 and key slot 108 of coupler 104 to tie the coupler to the rest of the EOCC draft gear assembly. The cross key is retained in the above slots by cross key retaining mechanism 120. As shown particularly in FIGS. 6-8, the transition faces in the transition portion of coupler 20 are arcuate to avoid longitudinal contact with the retaining mechanism. In other words, because of the shape of the transition faces, cross key 20 is spaced from the retaining mechanism to avoid or substantially avoid longitudinal contact with the retaining mechanism as compared to prior art cross keys.

Figure 9:
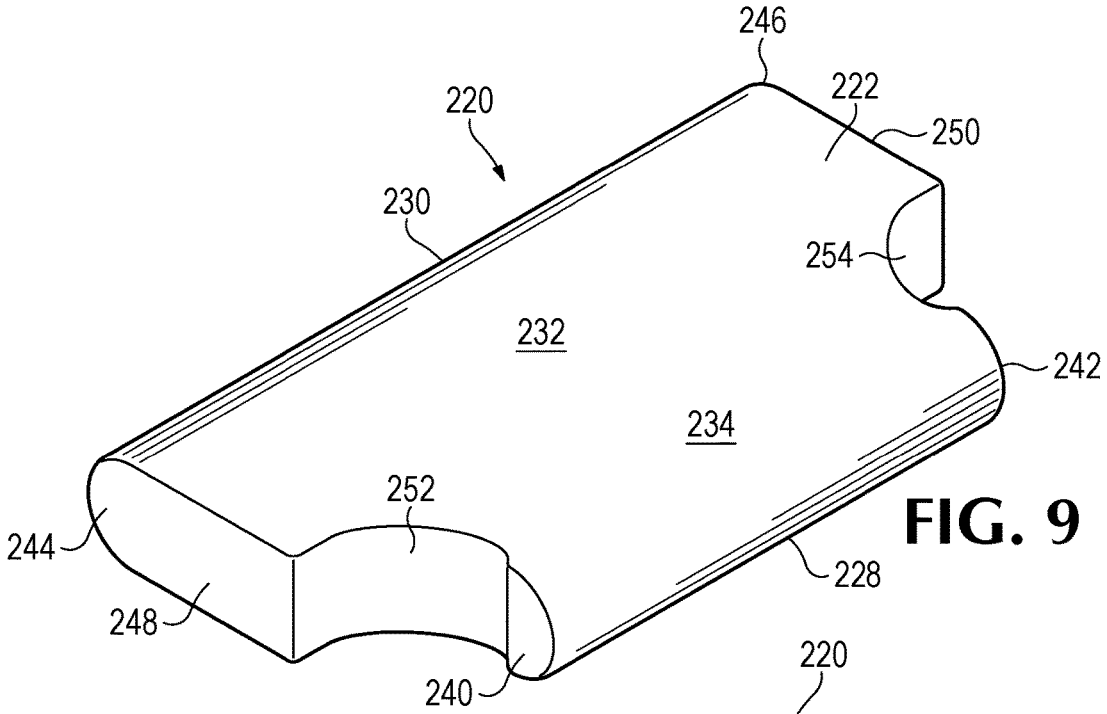
FIG. 9 is an isometric view of another example of a coupler cross key.
Figure 10:
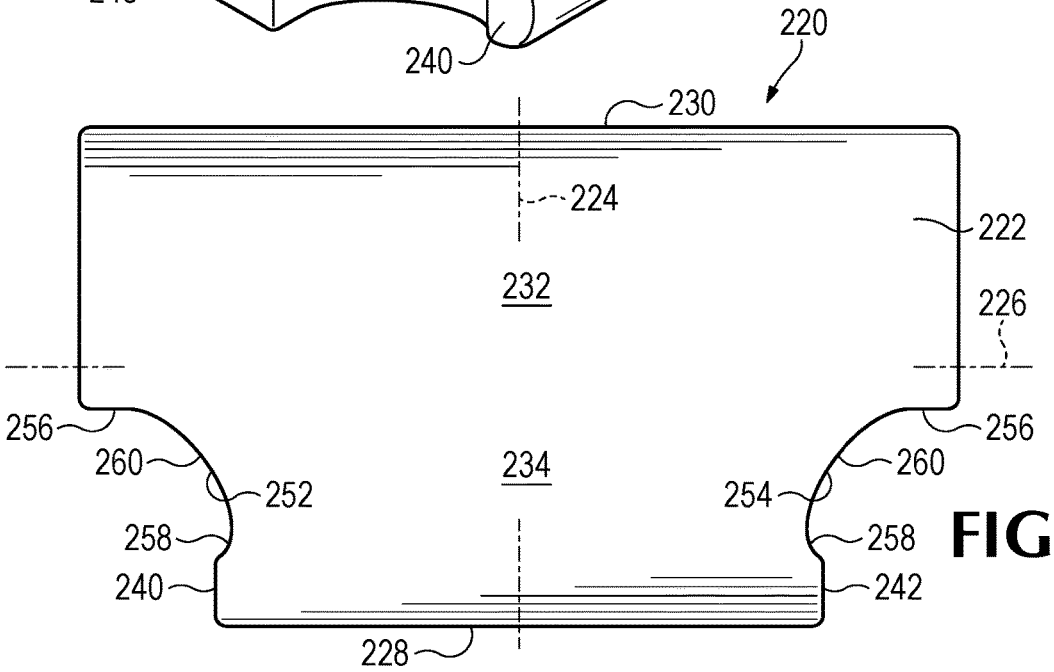
FIG. 10 is a top view of the coupler cross key of FIG. 9.
Figure 11:
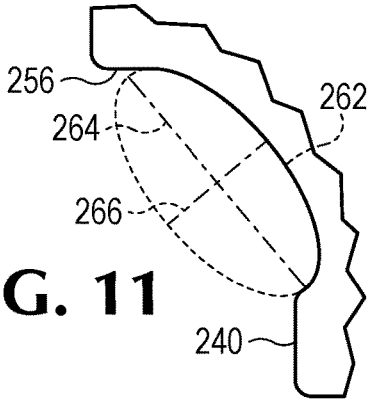
FIG. 11 is a partial view of the coupler cross key of FIG. 9, showing a transition face having a shape a portion of an outer surface of an ellipse.

Referring to FIGS. 9-11, another example of cross key 20 is shown generally indicated at 220. Unless explicitly excluded, cross key 220 may include one or more portions and/or one or more structures of other cross keys of the present disclosure, including cross key 20. Cross key 220 includes many of the same or similar components or portions as cross key 20. Components of cross key 220 labeled 2XX are the same as or similar to components or portion of cross key 20 labeled XX. For example, cross key 220 includes opposed first and second end portions 228 and 230, a base portion 232, and a transition portion 234, which is the same or substantially similar to opposed first and second end portions 28 and 30, a base portion 32, and a transition portion 34 of cross key 20.

Cross key 220 includes transition faces 252 and 254. However, unlike cross key 20, at least a substantial part or all of each of transition faces 252 and 254 includes a shape of a portion of an outer surface of ellipse 262 having a major axis 264 and a minor axis 266. The ellipse may have any suitable dimensions. In the example shown in FIGS. 9-11, the ellipse has a diameter of about 2.125 inches along the major axis, and a diameter of about one inch along the minor axis. However, the transition faces of cross key 220 (or at least a substantial part of those faces) may have a shape of a portion of an outer surface of ellipse 262 having different dimensions along the major and minor axes.

Figure 12:
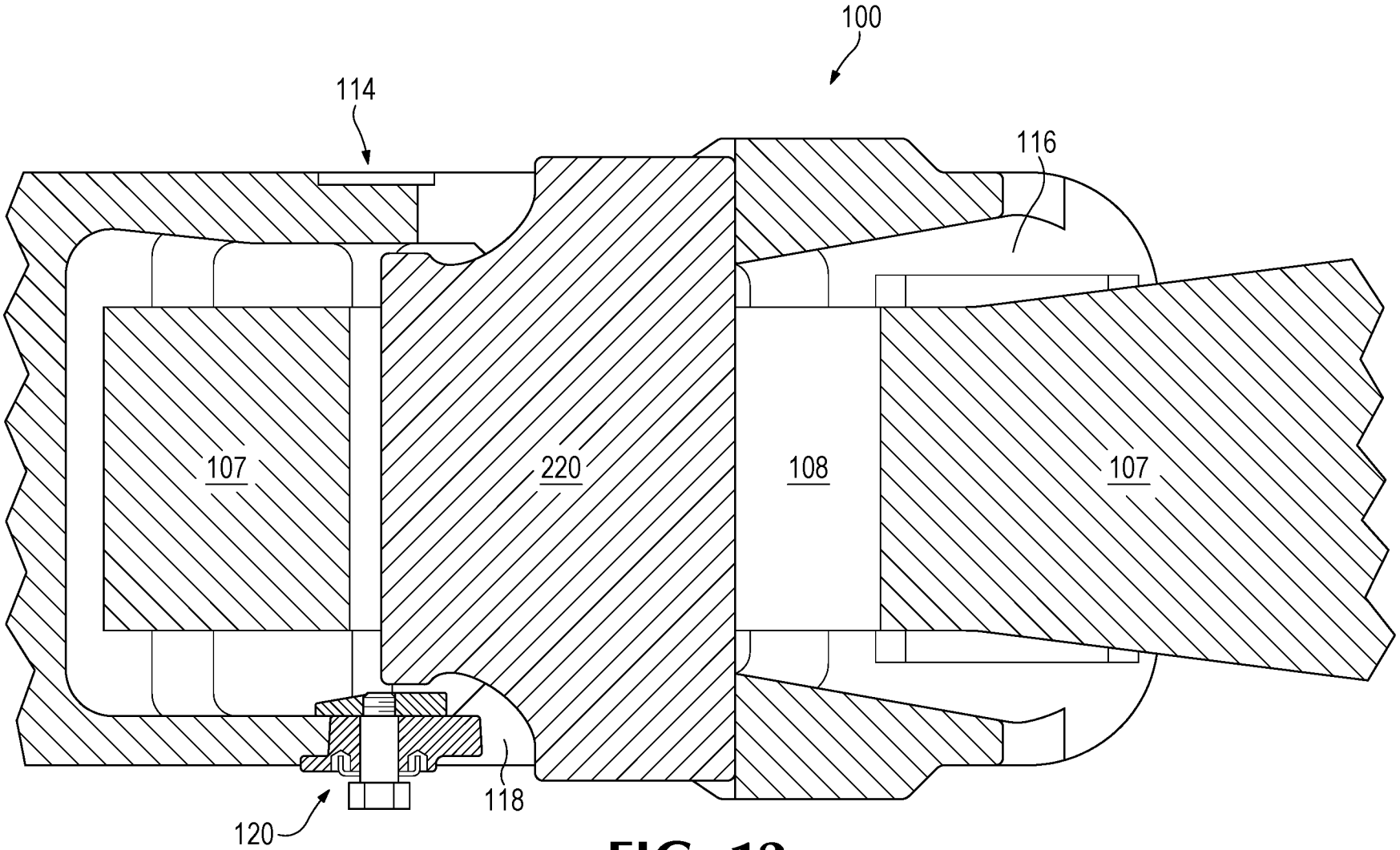
FIG. 12 is a partial sectional view of FIG. 6 showing the EOCC draft gear assembly in use with the coupler cross key of FIG. 9.

Referring to FIG. 12, end-of-car-cushioning (EOCC) draft gear assembly 100 is shown having cross key 220. Similar to cross key 20, the transition faces in the transition portion of cross key 220 are arcuate to avoid longitudinal contact with the retaining mechanism. In other words, because of the shape of the transition faces, cross key 220 is spaced from the retaining mechanism to avoid or substantially avoid longitudinal contact with the retaining mechanism as compared to prior art cross keys.

The shapes of the cross keys of the present disclosure are particularly significant because they reduce stresses at the inside corners while also avoiding damage to the cross key retaining mechanism. Instead of just increasing the inside corner radius (which would allow the key radius area to push longitudinally on the cross key retaining mechanism and result in damage to the cross key or retaining mechanism), the shapes of the cross keys of the present disclosure are particularly constructed to prevent longitudinal contact and reduce the potential for damage.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A cross key for an end-of-car-cushioning (EOCC) draft gear assembly consisting of a unitary generally T-shaped member, the T-shaped member including:

opposed lateral first and second end portions each having a semi-cylindrical shape, each of the first and second end portions having opposed longitudinal end faces, the first end portion having a length that is greater than length of the second end portion, the second end portion centered about a lateral axis defined by the T-shaped member;

a base portion formed with the first end portion, the base portion having a rectangular prism shape and having longitudinal end faces that are co-planar with the longitudinal end faces of the first end portion; and a transition portion disposed between the base portion and the second end portion and formed with the base portion and the second end portion, the transition portion generally having a trapezoidal prism shape, the transition portion including opposed longitudinal first and second transition faces, the first transitional face connecting a longitudinal end face of the base portion with a longitudinal end face of the second end portion, the second transitional face connecting the other longitudinal end face of the base portion with the other longitudinal end face of the second end portion, wherein each of the first and second transition faces has a shape that includes two or more radiuses of curvature, wherein each of the first and second transition faces includes opposed first and second end portions and a third intermediate portion disposed between the first and second end portions, and wherein the first end portion has a radius of curvature that is different from the third intermediate portion.

2. The cross key of claim 1, wherein the second end portion has a radius of curvature that is different from the third intermediate portion.

3. The cross key of claim 2, wherein the first end portion has a radius of curvature that is the same as radius of curvature of the second end portion.

4. The cross key of claim 3, wherein the radius of curvature of the first and second end portions is about 0.5 inches.

5. An end-of-car-cushioning (EOCC) draft gear assembly, comprising:

a yoke having a top wall, a bottom wall that is spaced and parallel to the top wall, and two side walls perpendicular to the top and bottom walls, the side walls connect the top and bottom walls to define a cavity therebetween, the side walls including corresponding yoke slots;

a coupler having a coupler head and a coupler body, wherein the cavity of the yoke is sized to receive an end portion of the coupler body, and wherein the coupler body includes a coupler slot that corresponds with the yoke slots when the end portion of the coupler body is received in the cavity; and the cross key of claim 3 sized to fit through the yoke slots and the coupler slot to secure the yoke to the coupler.

6. The cross key of claim 1, wherein the third intermediate portion has a radius of curvature of about three inches.

7. The cross key of claim 6, wherein each of the first and second transition faces includes only two radiuses of curvature.

8. The cross key of claim 1, wherein at least a substantial part of each of the first and second transition faces has a shape of a portion of an outer surface of an ellipse.

9. The cross key of claim 8, wherein the ellipse has a diameter along the major axis of about 2.125 inches and a diameter along the minor axis of about one inch.

10. An end-of-car-cushioning (EOCC) draft gear assembly, comprising:

a yoke having a top wall, a bottom wall that is spaced and parallel to the top wall, and two side walls perpendicular to the top and bottom walls, the side walls connect the top and bottom walls to define a cavity therebetween, the side walls including corresponding yoke slots;

a coupler having a coupler head and a coupler body, wherein the cavity of the yoke is sized to receive an end portion of the coupler body, and wherein the coupler body includes a coupler slot that corresponds with the yoke slots when the end portion of the coupler body is received in the cavity; and the cross key of claim 8 sized to fit through the yoke slots and the coupler slot to secure the yoke to the coupler.

11. The cross key of claim 1, wherein a part of the transition portion has a length that is less than length of the second end portion, the part of the transition portion being adjacent to the second end portion and spaced from the first end portion.

12. An end-of-car-cushioning (EOCC) draft gear assembly, comprising:

a yoke having a top wall, a bottom wall that is spaced and parallel to the top wall, and two side walls perpendicular to the top and bottom walls, the side walls connect the top and bottom walls to define a cavity therebetween, the side walls including corresponding yoke slots;

a coupler having a coupler head and a coupler body, wherein the cavity of the yoke is sized to receive an end portion of the coupler body, and wherein the coupler body includes a coupler slot that corresponds with the yoke slots when the end portion of the coupler body is received in the cavity; and the cross key of claim 1 sized to fit through the yoke slots and the coupler slot to secure the yoke to the coupler.

13. A cross key for an end-of-car-cushioning (EOCC) draft gear assembly consisting of a unitary generally T-shaped member, the T-shaped member including:

opposed lateral first and second end portions each having a semi-cylindrical shape, each of the first and second end portions having opposed longitudinal end faces, the first end portion having a length that is greater than length of the second end portion, the second end portion centered about a lateral axis defined by the T-shaped member;

a base portion formed with the first end portion, the base portion having a rectangular prism shape and having longitudinal end faces that are co-planar with the longitudinal end faces of the first end portion; and a transition portion disposed between the base portion and the second end portion and formed with the base portion and the second end portion, the transition portion generally having a trapezoidal prism shape, the transition portion including opposed longitudinal first and second transition faces, the first transitional face connecting a longitudinal end face of the base portion with a longitudinal end face of the second end portion, the second transitional face connecting the other longitudinal end face of the base portion with the other longitudinal end face of the second end portion, wherein each of the first and second transition faces has a shape that includes two or more radiuses of curvature, and wherein at least a substantial part of each of the first and second transition faces has a shape of a portion of an outer surface of an ellipse.

* * * * *